United States Patent [19]

Smilgys

[11] 4,365,146

[45] Dec. 21, 1982

[54] ROTARY DRIVE ANTI-BACKLASH DEVICE

[75] Inventor: Bruno S. Smilgys, Hartford, Conn.

[73] Assignee: Veeder Root Industries Inc., Hartford, Conn.

[21] Appl. No.: 309,818

[22] Filed: Oct. 8, 1981

[51] Int. Cl.[3] ..... G06C 25/00

[52] U.S. Cl. ..... 235/131 R; 235/94 R; 74/440

[58] Field of Search ... 235/61 L, 61 M, 131 R-131 JA, 235/94 R-94 A, 91 R; 74/152, 440

[56] References Cited

U.S. PATENT DOCUMENTS

| | | | |
|---|---|---|---|
| 2,814,444 | 11/1957 | Bliss | 235/94 R |
| 3,251,544 | 5/1966 | Pilz et al. | 235/91 R |
| 3,847,347 | 11/1974 | Smilgys | 235/131 R |

*Primary Examiner*—Benjamin R. Fuller

*Attorney, Agent, or Firm*—Prutzman, Kalb, Chilton & Alix

[57] ABSTRACT

A fuel pump cost counter anti-backlash device having a follower rotor connected by a reverse bias spring to the cost counter drive train for removing any inertia overtravel in the drive train at the termination of a fuel delivery and a controlled coil spring clutch for clutching the follower rotor to a fixed drum for establishing a substantially constant reverse bias.

7 Claims, 2 Drawing Figures

ROTARY DRIVE ANTI-BACKLASH DEVICE

TECHNICAL FIELD & BACKGROUND ART

The present invention relates generally to rotary drive anti-backlash devices (of the type shown and described in Pilz et al U.S. Pat. No. 3,251,544, dated May 17, 1966 and entitled "Gear Train Control Arrangement" and in Smilgys U.S. Pat. No. 3,847,347, dated Nov. 12, 1974 and entitled "Rotary Drive Anti-Backlash Device") and more particularly to a new and improved rotary drive anti-backlash device having notable application with a counter drive train for eliminating any inertia overtravel and resulting count inaccuracy.

DISCLOSURE OF THE INVENTION

It is a principal aim of the present invention to provide a new and improved anti-backlash device for a conventional fuel pump register for removing any inertia overtravel and resulting count inaccuracy of the usual cost and/or volume counters of the register at the cessation of a fuel delivery.

It is another aim of the present invention to provide a new and improved rotary drive anti-backlash device having an economical design and providing a preestablished overtravel return bias for eliminating any inertia overtravel by preventing overtravel and/or removing any overtravel if it occurs.

It is a further aim of the present invention to provide a new and improved rotary drive anti-backlash device of the type described providing reliable operation over a long useful life.

Other objects will be in part obvious and in part pointed out more in detail hereinafter.

A better understanding of the invention will be obtained from the following detailed description and the accompanying drawing of an illustrative application of the invention.

BEST MODE FOR CARRYING OUT THE INVENTION

Figure 1:
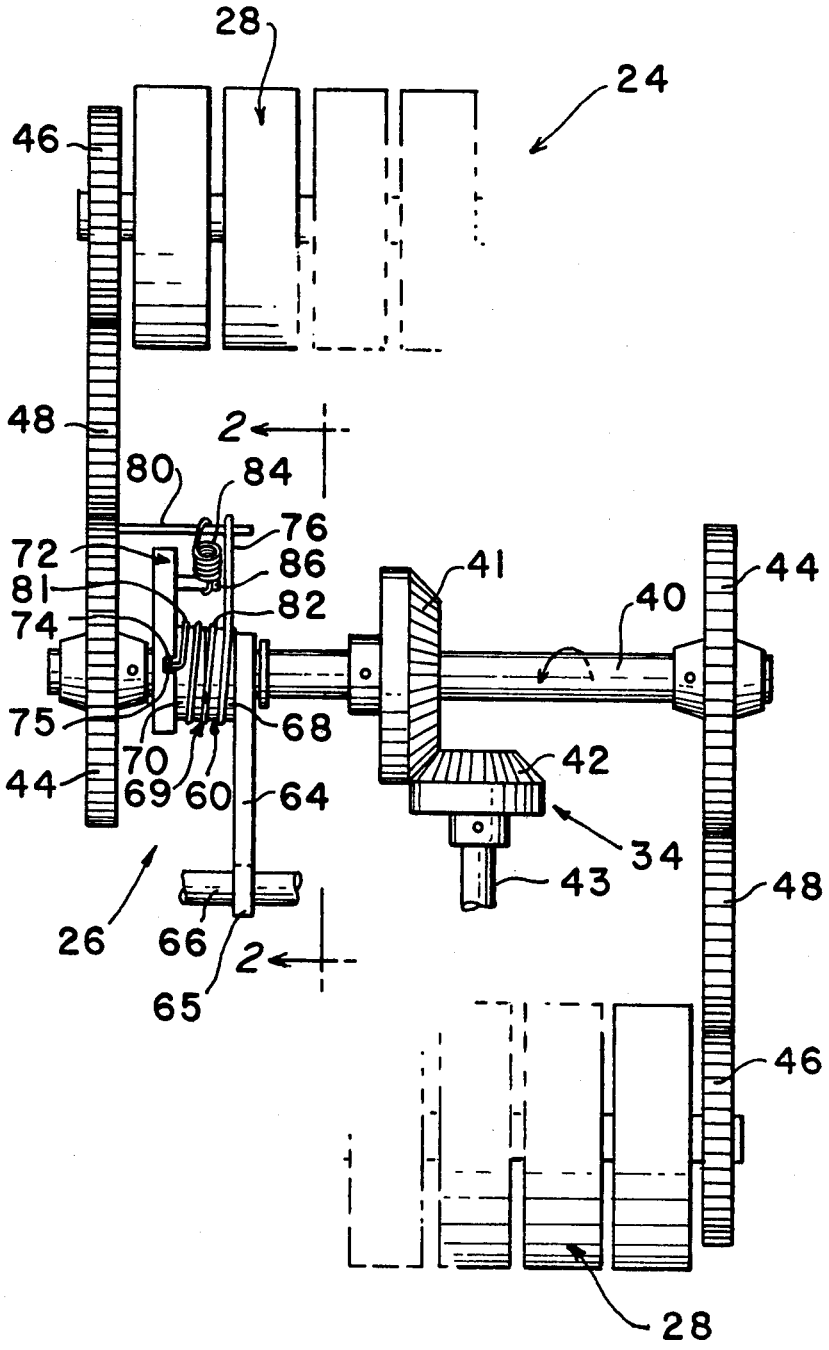
FIG. 1 is a generally diagrammatic top plan view, partly broken away and partly in section, of a fuel delivery pump register incorporating an embodiment of a rotary drive anti-backlash device of the present invention.

Referring now to the drawing in detail wherein like reference numerals indicate like parts throughout, a resettable fuel delivery pump register 24 incorporating an embodiment 26 of a rotary drive anti-backlash device of the present invention is shown having a pair of cost counters 28 for registering the cost amount of fuel dispensed.

The resettable register 24 may, for example, be of the type shown in U.S. Pat. No. 2,814,444 of Harvey N. Bliss, dated Nov. 26, 1957 and entitled "Register" and is therefore not disclosed and described in detail herein.

A register drive train 34 to the cost counters 28 comprises a horizontal cross or center shaft 40 driven via suitable bevel gearing 41, 42 by a vertical shaft 43 which in turn is driven by a unit volume price variator (not shown) with which the register is associated in a conventional manner. Gears 44 fixed to opposite ends of the center shaft 40 drive the lowest order counter wheel gears 46 of the cost counters 28 via intermediate idler gears 48. Thus, the two cost counters 28 are driven together via the cross shaft 40 for registering the cost amount of fuel dispensed in accordance with the unit volume price setting of the variator (not shown) with which the register is associated. In the same manner, a lower horizontal cross or center shaft (not shown) is driven by a variator center shaft (not shown) to drive a pair of volume counters (not shown) of the register for registering the volume amount of fuel dispensed.

The cost counters 28 (and the volume counters, not shown) are resettable between deliveries and as will be seen upon reference to the aforementioned U.S. Pat. No. 2,814,444, the cost and volume counters are temporarily disengaged from their respective lowest order counter wheel drive gears 46 by the register reset mechanism during the register reset cycle. In accordance with the present invention, the rotary drive anti-backlash device 26 is mounted in association with the rotary drive train 34 to the cost counters 28. Also, if desired, an identical rotary drive anti-backlash device (not shown) is mounted in association with the drive train to the volume counters.

In the embodiment shown, the anti-backlash device 26 comprises a friction drum 60 coaxially mounted on the center shaft 40 and having an integral radially extending arm 64 with a bifurcated outer end 65 receiving a tie rod 66 of the register frame for keying the drum 60 against rotation. A helical coil spring 69 is mounted on a cylindrical friction drum section 68 provided by the fixed drum 60 and also on an abutting coaxial cylindrical friction drum section 70 provided by a reverse bias follower 72 rotatably mounted on the center shaft 40. The helical coil spring 69 has a first fixed end 74 received within a slot 75 in the reverse bias follower 72 and a second free, tangentially extending end 76. The free end 76 of the helical coil spring 69 is engageable by an axially extending post 80 mounted on one of the center shaft gears 44 as the center shaft 40 rotates during the delivery of fuel, in a counter-clockwise direction as viewed in FIG. 2.

The helical coil spring 69 has multiple-coil spring sections 81, 82 each with a plurality of helical friction coils, surrounding and in frictional engagement with the drum sections 68,70 respectively. The helical coil spring 69 has a normal or unstressed diameter slightly less than the common diameter of the coaxial abutting cylindrical drum sections 68, 70. Accordingly, the helical coil spring 69 frictionally engages each of the abutting drum sections 68, 70 to clutch the two drum sections 68, 70 together and thereby frictionally resist or brake the normal rotation of the reverse bias follower 72 in the counter-clockwise direction as viewed in FIG. 2. Also, the helical coil spring 69 is preferably formed of wire having a square cross section and so that adjacent coils are axially spaced slightly in the stressed or expanded condition of the coil spring and each coil has a flat area of contact engaging the cylindrical drum formed by the two abutting drum sections 68, 70.

The reverse bias follower 72 is connected to be rotated by the center shaft 40 via a reverse bias or return tension spring 84 connected between the gear mounted post 80 and an axially extending post 86 mounted on the follower 72. Thus the reverse bias spring 84 urges the follower 72 to rotate with the shaft 40 as the shaft 40 rotates during the delivery of fuel. However, because the reverse bias follower 72 is frictionally clutched by the helical coil spring 69 to the fixed drum section 68, the reverse bias spring 84 becomes angularly extended or loaded to place a reverse bias on the cost counter drive train 34.

Figure 2:
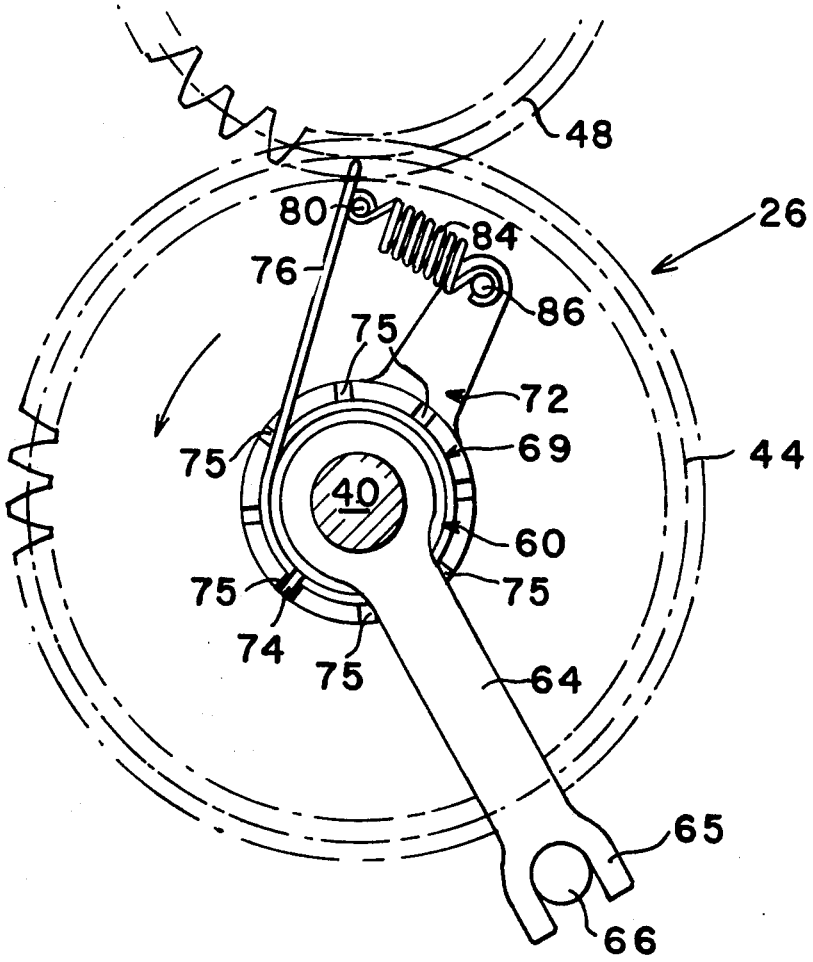
FIG. 2 is an enlarged partial side elevation section view, partly broken away and partly in section, of the register showing the rotary drive anti-backlash device in greater detail.

The coil spring 69 is coiled to extend helically from its free end 76 in the same angular direction as the direction of rotation of the follower 72, in the counter-clockwise direction as viewed in FIG. 2. Accordingly, the helical coil spring 69 is contracted or tightened by such rotation of the follow 72 to effectively lock or brake the follower 72 against rotation. Thus, prior to engagement by the gear mounted post 80 with the free end 76 of the coil spring 69, the coil spring 69 will lock the reverse bias follower 72 to the fixed drum 60 to load the return spring 84 and thereby place a reverse torsional bias on the cost counter drive train 34. The return spring 84 is thereby angularly loaded a preestablished amount before the gear mounted post 80 engages the free end 76 of the coil spring 69. The resulting pre-established reverse bias is dependent on the spring rate of the return spring 84 and the spring displacement established by the angular displacement of the two relatively rotatable mounting posts 80, 86 when the free end 76 of the coil spring 69 is engaged by the post 80.

Accordingly, the coil spring 69 will, through engagement with the drum section 68, brake the reverse bias follower 72 against rotation until the gear mounted post 80 engages the free end 76 of the coil spring 69 to release the brake. The reverse bias follower 72 will then rotate with the center shaft 40 to maintain a relatively constant reverse bias to the center shaft drive train 34 during the delivery of fluid. That constant reverse angular bias on the rotary drive train 34 can be accurately established by the selection of an appropriate return spring 84 and the spring displacement at which the spring clutch is released by the gear mounted post 80. To provide for setting or adjusting the spring displacement, the reverse bias follower 72 is provided for example with eight equiangularly spaced slots 75 for selectively receiving the fixed end 74 of the spring 69.

The reverse angular bias on the rotary drive train 34 will assist in reducing any inertia overtravel of the rotary drive train 34 which might occur because of the normal "play" on backlash in the rotary drive train, such inertia overtravel typically occurring when the fuel delivery is quickly terminated especially from a high delivery rate. More significantly, the reverse angular bias of the loaded return spring 84 is effective in angularly returning the rotary drive train 34 in the reverse angular direction and remove any inertia overtravel of the rotary drive train 34 when it occurs. In addition, the reverse angular bias provided by the return spring 84 holds the rotary drive train 34 in proper drive engagement and prevents any vibration or shock caused forward rotary movement of the rotary drive train when the cost counters 28 are disengaged for being reset. Thus, after the counters are reset and upon the commencement of a fuel delivery, the rotary drive train is substantially free of "play" in the driving direction.

The angular loading of the return spring 84 during normal rotation of the rotary drive train is preferably substantially greater than the maximum potential inertia overtravel of the rotary drive train 34 at the shaft 40 and such that there is sufficient remaining reverse angular bias on the rotary drive train 34, after removal of the inertia overtravel, to prevent forward rotary movement of the rotary drive train 34 while the cost counters 28 are being reset.

In the embodiment of the rotary drive anti-backlash device which has been shown and described, the friction drum 60 is fixed and the post 80 (which serves the dual purpose of engaging the free end 76 of the helical coil spring 69 and connecting the return spring 84 to the drive train 34) is rotated by the drive train 34. In the alternative, the drum 60 could be rotated by the drive train 34 and the post 80 be fixed, in which case the reverse bias of the return spring 84 is transmitted to the drive train 34 via the coil spring clutch and the drum 60.

In either alternative, the anti-backlash device of the present invention employs very few inexpensive parts, can be readily mounted in association with a rotary drive train, and provides for removing all "play" in the rotary drive train in the driving direction.

As will be apparent to persons skilled in the art, various modifications, adaptations and variations of the foregoing specific disclosure can be made without departing from the teachings of the present invention.

I claim:

1. In a resettable fluid delivery register having a resettable rotary counter with a plurality of coaxial rotary counter wheels of ascending order, a rotary drive train connected to the lowest order counter wheel to rotate the counter for registering the amount of fluid delivered, and rotary drive anti-backlash means for removing inertia overtravel in the rotary drive train upon termination of a fluid delivery, the anti-backlash means comprising first rotary member means connected to be rotated in one angular direction thereof by the rotary drive train, second non-rotatable member means, a reverse bias follower rotatable coaxially with said first rotary member means, reverse bias spring means interconnecting the follower and one of said member means, and friction means interconnecting the follower and the other of said member means to restrain relative angular rotation thereof and thereby to bias the said first rotary member means in its reverse angular direction to its said one angular direction with the reverse bias spring means, the improvement wherein the said other member means comprises a first annular friction drum coaxial with the follower, wherein the friction means comprises a coil spring having a first free end, a second end connected to said follower, and an intermediate helical coil spring section in frictional engagement with said first annular friction drum and extending generally helically from its said first free end in an angular direction to increase the frictional engagement of the coil spring section with the first annular friction drum with the reverse bias spring means, and wherein the said one member means comprises means engageable with the said free end of the coil spring to reduce the frictional engagement of the coil spring section with the first annular friction drum at a predetermined angular loading of the reverse bias spring means.

2. In a resettable fluid delivery register having a resettable rotary counter with a plurality of coaxial rotary counter wheels of ascending order, a rotary drive train connected to the lowest order counter wheel to rotate the counter for registering the amount of fluid delivered, and rotary drive anti-backlash means for removing inertia overtravel in the rotary drive train upon termination of a fluid delivery, the anti-backlash means comprising first rotary member means connected to be rotated in one angular direction thereof by the rotary drive train, second non-rotatable member means, a reverse bias follower rotatable coaxially with said first rotary member means, reverse bias spring means interconnecting the follower and one of said member means, and follower restraining means interconnecting the follower and the other of said member means to restrain relative angular rotation thereof and thereby to bias the said first rotary member means in its reverse angular direction to its said one angular direction with the reverse bias spring means, the improvement wherein the follower restraining means comprises releasable clutch means interconnecting the follower and the said other member means, and wherein the said one member means comprises means engageable with the said releaseable clutch means to limit the angular loading of the reverse bias spring means.

3. A fluid delivery register according to claim 1 wherein the follower has a second annular friction drum coaxial with and adjacent to said first annular friction drum, and wherein the intermediate helical coil spring section is also in frictional engagement with said second annular friction drum.

4. A fluid delivery register according to claim 1 or 2 wherein the said one member means is the first rotary member means.

5. A fluid delivery register according to claim 3 wherein the intermediate helical coil spring section is formed by a plurality of continuous helical coils.

6. In a rotary drive train having a rotary drive member, a rotary driven member, intermediate rotary drive means interconnecting the rotary drive and driven members for rotating the rotary driven member in a first angular direction thereof by rotation of the rotary drive member in a first angular direction thereof, the rotary drive train having rotary backlash between the rotary drive and driven members, and rotary drive anti-backlash means for removing angular overtravel of the driven member in said first angular direction thereof, the rotary drive anti-backlash means comprising a first annular friction drum member, a rotatable follower coaxial with the first annular friction drum member, a coil spring having a first end connected to the follower, a second free end, and an intermediate helical coil spring section having a plurality of coaxial coils in frictional engagement with the said first annular friction drum member, a reaction member, and a reverse bias spring interconnecting the follower and reaction member, one of said members being connected to the rotary drive train for relative rotation thereof in one angular direction with respect to the other member, the helical coil spring section extending generally helically from its said second free end in an angular direction tending to increase its frictional engagement with the said first annular friction drum member upon said relative rotation of said one member to restrain said relative rotation with the reverse bias spring, the reaction member being engageable with the said second free end of the coil spring at a predetermined angular loading thereof to thereupon decrease the frictional engagement of the helical coil spring section with the said first annular friction drum member to control the return spring restraint of said relative rotation.

7. A rotary drive train according to claim 6 wherein the follower has a second annular friction drum coaxial with and adjacent to said first annular friction drum member, and wherein the coil spring section is in frictional engagement with the said second annular friction drum.

* * * * *